US006171113B1

(12) United States Patent
Wada et al.

(10) Patent No.: US 6,171,113 B1
(45) Date of Patent: Jan. 9, 2001

(54) CARD CONNECTOR COMPRISING A CONNECTOR ELEMENT AND A FRAME ELEMENT READILY ATTACHABLE TO AND DETACHABLE FROM THE CONNECTOR ELEMENT

(75) Inventors: Takamitsu Wada, Tokorozawa; Akira Kimura, Kokubunji; Manabu Ito, Hirosaki, all of (JP)

(73) Assignee: Japan Aviation Electronics Industry, Limited, Tokyo (JP)

( * ) Notice: Under 35 U.S.C. 154(b), the term of this patent shall be extended for 0 days.

(21) Appl. No.: 09/312,424

(22) Filed: May 14, 1999

(30) Foreign Application Priority Data

Jul. 17, 1998 (JP) ..... 10-203370

(51) Int. Cl.[7] ..... H01R 12/00

(52) U.S. Cl. ..... 439/64; 439/377

(58) Field of Search ..... 439/64, 377, 342, 439/633, 677, 680, 326

(56) References Cited

U.S. PATENT DOCUMENTS 5,288,247 * 2/1994 Kaufman ..... 439/607
5,308,251 * 5/1994 Kaufman et al. ..... 439/64
5,389,001 * 2/1995 Broschard, III et al. ..... 439/159
5,478,260 * 12/1995 Kaufman et al. ..... 439/609

* cited by examiner

*Primary Examiner*—T. C. Patel
(74) *Attorney, Agent, or Firm*—Laff, Whitesel & Saret, Ltd.; J. Warren Whitesel

(57) ABSTRACT

A new card connector has a connector element which has, at its opposite ends, projection portions, and a frame element which has a projection guide having a laterally elongated portion in parallel to a card insertion-withdrawal direction at a coupling portion between the frame element and the connector element. When the frame element is coupled with or released from the connector element fixed to a mounting board, an upper side of the laterally elongated portion of the projection guide of the frame element is guided by the projection portion of the connector element so that any contact is prevented between a grounding metal plate of the frame element and pin contacts of the connector element. When the frame element is to be coupled with the connector element by pushing it from the above toward the connector element, a lower side portion of the laterally extended portion of the projection guide is abutted against the projection portion of the connector element and, therefore, the grounding metal plate is prevented from being contacted with the pin contacts. Thus, in coupling and decoupling between the frame element and the connector element, no special care is required so as to avoid an interference between the grounding metal plate and the pin contacts, and desirable coupling and decoupling operation can be made without damages of the pin contacts.

3 Claims, 10 Drawing Sheets

CARD CONNECTOR COMPRISING A CONNECTOR ELEMENT AND A FRAME ELEMENT READILY ATTACHABLE TO AND DETACHABLE FROM THE CONNECTOR ELEMENT

BACKGROUND OF THE INVENTION

The present invention relates in general to a card connector and more particularly to a card connector of the type which is used for mounting a card on a mounting board wherein the card has a plurality of contacting portions arranged along one side of the card and a plurality of grounding electrodes adjacent to the arrangement of the contacts.

Among various types of cards of the type described above, there are cards in which a transfer of a general signals to and from the mounting board and connection to the mounting board for the ground wires are divided from each other and conducted separately. This type of card has in general a plurality of contacting portions for a general signals arranged along one side of the card and, in addition, a plurality of grounding electrodes adjacent to the arrangement of the contacts. An example of this type of the conventional card connector will be explained first with reference to FIGS. 6 through 10.

The conventional card connector comprises a connector element 100*x* and a frame element 200*x*, the detail of which will be explained below.

The connector element has a plurality of pin contacts 110 one end side of which are correspondingly connectable with the arranged contacts mounted on the card and the other side of which are correspondingly connectable with the arranged pin contacts 110 through a terminal 150, and an insulator 120 which hold the pin contacts 110 so that their axial direction is parallel with the insertion-withdrawal direction or a first direction and so that the insulator 120 is fixedly held to the mounting board 300 by a hold-down member 130.

The frame element 200*x* has: (1) a guide portion 210 which are connected with opposite sides of the insulator 120 of the connector element 100*x* and extended in the insertion-withdrawal direction of the card and serves to guide the opposite surface portions of the card at the time of insertion-withdrawal of the card; (2) a metal frame portion 220 which serves to connect the card-guide portion 210 together at its upper side (that is, lower side of FIG. 7); (3) a grounding metal plate 230 having a plurality of contacts 231 and connects the card guides 210 together at a portion which is adjacent to the connector element 100*x* of its lower surface side (an upper portion of FIG. 7) and serves to connect the contacts 231 with the grounding electrodes of the mounted card for connecting these grounding electrodes with the grounding wire of the mounting board 300; (4) a card forcing device 240 which has a push button 241 disposed at an end portion of each of the guide portions 210 so that it is pushed by manipulation at the time of card withdrawal, an ejecting bar 242 disposed on the side portions of the card guides 210 for transmitting a pushing force of the push buttons 241, a card forcing plate 244 which is disposed between the card guides 210 for forcing (or pushing) out the card from the connector element, and a lever 243 for transmitting a force of the ejecting lever 242 to the card forcing plate 244; and (5) an earth lug portion 250 which is disposed on the lower surface of each of the card guides 210 for providing an unnecessary or excessive electric current of each part and portions of the device to the grounding wire of the mounting board 300.

The conventional card connector described above has a structure that, as shown in FIG. 9, the connector element 100*x* is fixedly held to the mounting board 300. The terminals 150 are connected by soldering or the like with the electrodes of the mounting board 300 and then the electrodes and the pin contacts 110 are connected with each other. Then, the frame element 200*x* is displaced from an obliquely forward portion of the connector element 100*x* (that is, from a tip end direction of the pin contacts 110, which is shown at the right top direction in FIG. 9 for the purpose of showing a fixedly holding position between the mounting board 300 and the frame element 200*x* in FIG. 9) so that the frame element 200*x* is slid or moved along a surface of the mounting board 300. Thus, the frame element 200*x* is coupled with the connector element 100*x* and, at the same time, fixed to the mounting board 300 as shown in FIG. 10.

When a card is required to be inserted into the card connector, the card is pushed into the card guide portion 210. On the other hand, when the push button 241 of the card forcing device 240 is pushed by a fingertip operation, the pushing force is transmitted from the push button 241 to the card forcing plate 244 to permit the card to be removed from the connector element 100*x*. Therefore, the card can be withdrawn easily.

The conventional card connector explained above has the structure in that the grounding metal plate 230 is disposed for coupling the card guides 210 at the portion adjacent to the connector element 100*x*, the frame element 200*x* being coupled with the connector element 100*x* after the connector element 100*x* is previously fixed to the mounting board 300. In this structure, when the connector element 100*x* and the frame element 200*x* are coupled together, the grounding metal plate 230 is disposed between the pin contacts 110 and the mounting board. Accordingly, as shown in FIG. 10, the pin contacts 110 and the grounding metal plate 230 are partly overlapped with each other in a second direction perpendicular to the first direction. As a result, the overlapped portions are interfered with each other when the connector element 100*x* and the frame element 200*x* are coupled with or released from each other. Even if a care is taken to avoid such a overlapping when the coupling and releasing operation is conducted, the pin contacts 110 and the grounding metal plate 230 are hit against or collided with each other and results serious problems of damage and break of the pin contacts 110.

SUMMARY OF THE INVENTION

It is therefore an object of the present invention to provide a new card connector which can prevent interference between the overlapping portions of the pin contacts and the grounding metal plates at the time of coupling and releasing between the frame element and the connector element fixedly connected with the mounting board to prevent the pin contacts from being broken or damaged.

Other objects of the present invention will become clear as the description proceeds.

According to an aspect of the present invention, there is provided a card connector for use in connecting a card having a principal surface, an end surface adjacent to the principal surface, a contacting portion at the end surface, and a grounding electrode on the principal surface in the vicinity of the end surface. The card connector comprises a connector element fixedly mounted at a first position on a mounting board and a frame element detachably mounted at a second position on the mounting board. The connector element comprises a pin contact for becoming in contact with the contacting portion of the card, an insulator holding the pin contact in a form in which the pin contact extends in a first direction with a first space left between the pin contact and the mounting board in a second direction perpendicular to the first direction, and a projection portion projecting from the insulator, with a second space left between the projection portion and the mounting board, in a third direction perpendicular to the first and the second directions. The frame element comprises a card guide extending from the connector element for movably guiding the card in the first direction, a grounding metal plate connected to the card guide and placed in the first space for becoming in contact with the grounding electrode of the card, and a projection guide extending from the card guide in the first direction and inserted in the second space for being engaged with the projection portion to prevent the frame element from being detached in the second direction.

According to another aspect of the present invention, there is provided a card connector for mounting a card on a mounting board. The card has a plurality of contacting portions along one side thereof and a plurality of grounding electrodes arranged adjacent to the contacting portions so that the contacting portions and the grounding portions are connected respectively with electrodes and grounding wire of the mounting board when the card is inserted into the card connector. The card connector comprises a connector element and a frame element which are mounted on the mounting boards. The connector element comprises a plurality of pin contacts having one end portion connected with the contacting portions and other end portion connected with the electrodes of the mounting board, an insulator adaptable to the mounting board for holding the pin contacts with the axis of the pin contacts being parallel with an insertion-withdrawal direction of the card, and projection portions projecting outwardly from an array of opposite ends of the pin contacts. The frame element comprises a card guide connected with the opposite end portions of the insulator and extended in the insertion-withdrawal direction for guiding the opposite side surface portions of the card at the time of insertion-withdrawal of the card, a frame portion for coupling the card guide with each other, a grounding metal plate for coupling the card guide with each other at the portion adjacent to the connector element at the lower portion and connected with the grounding electrodes of the inserted card to connect the grounding electrodes with the grounding wire, and a projection guide in the form of a bank extending laterally and parallel with the insertion-withdrawal direction and having predetermined shape and height on a surface of the card guide opposite to the opposed end surfaces of the insulator at the connected portion between the card guide and the connector element. In the card connector, the projection guide serves to prevent contact between the grounding metal plate and the pin contacts when the card guide is coupled with the opposed end portion of the insulator to prevent the outer portion of the grounding metal plate from contacting with the pin contacts when the projection portion of the opposed end surfaces of the insulator is happened to contact with the longitudinally extending bank.

BRIEF DESCRIPTION OF THE DRAWING

FIGS. 1A and 1B are partly sectioned side views of a card connector according to an embodiment of the invention, wherein FIG. 1A shows the state before a frame element is coupled to a connector element fixed to a mounting board, FIG. 1B showing the state after the frame element is coupled to the connector element;

FIGS. 6A and 6B are partly sectioned side views of a conventional card connector, wherein FIG. 6A shows the state before a frame element is coupled to a connector element fixed to a mounting board, FIG. 1B showing the state after the frame element is coupled to the connector element;

DESCRIPTION OF THE PREFERRED EMBODIMENT

Figure 1A:
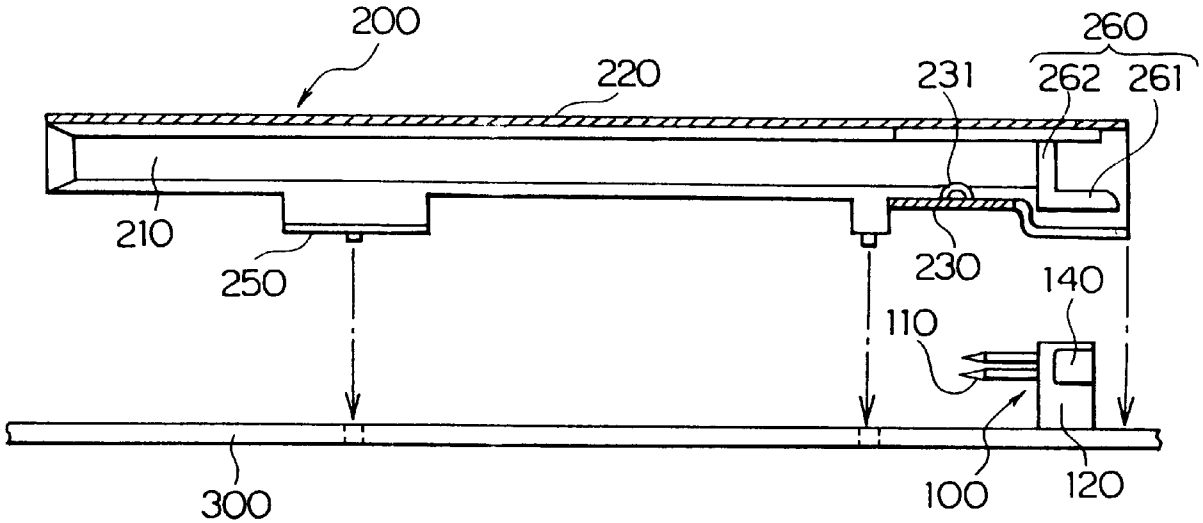
Figure 1B:
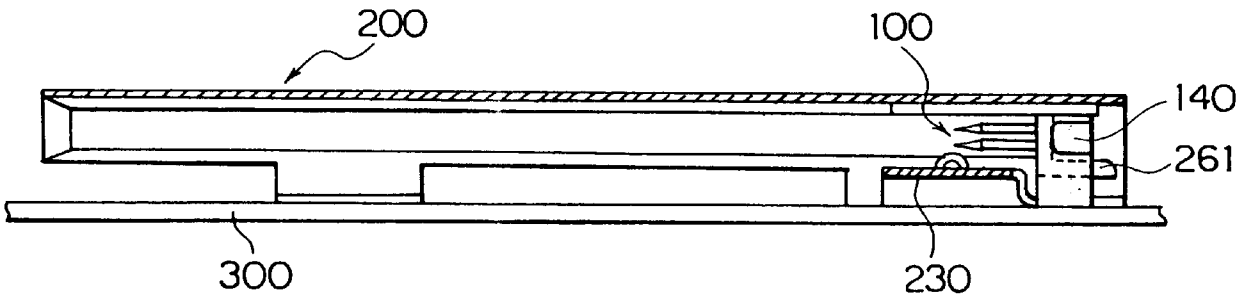
Figure 2:
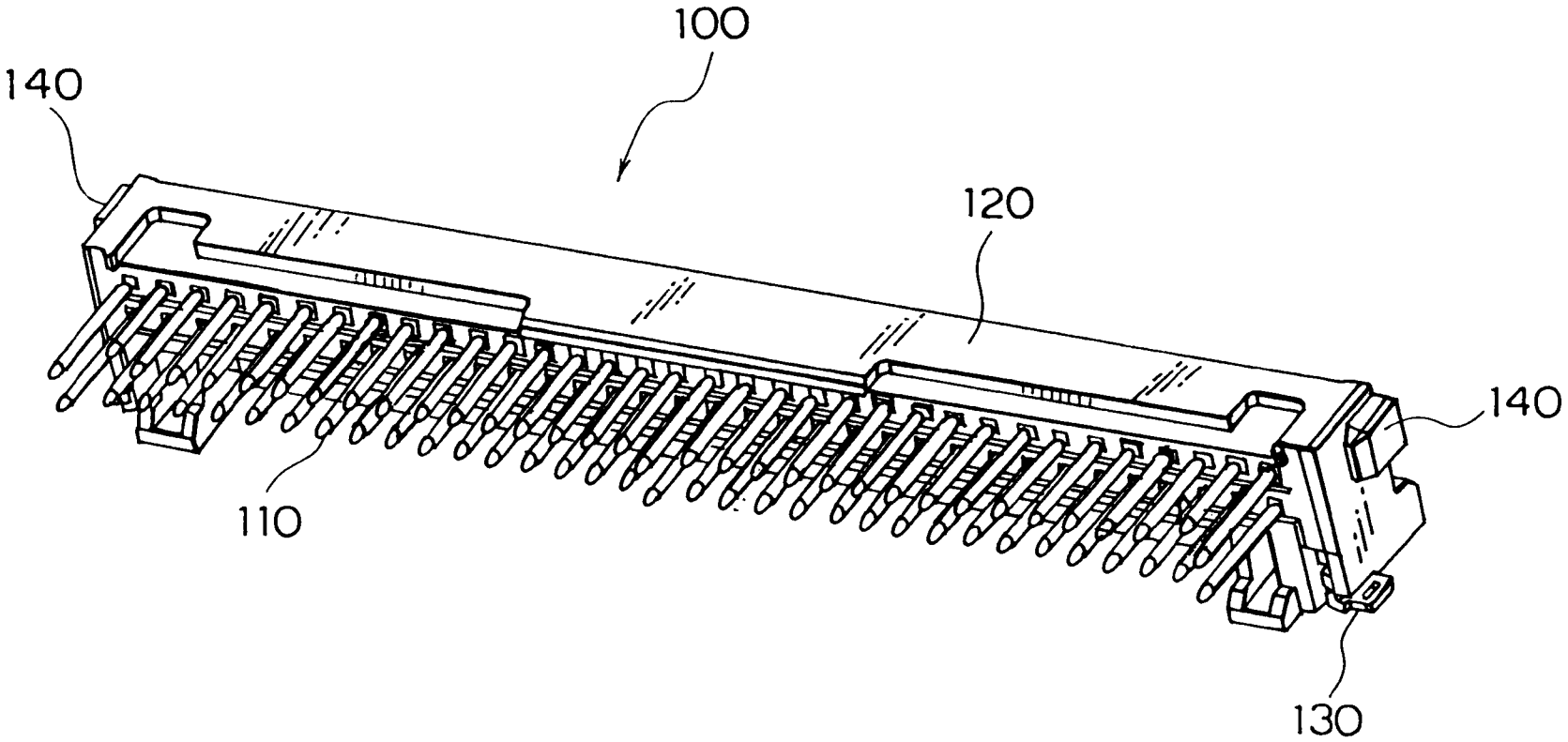
FIG. 2 is a perspective view of a connector element included in the card connector of FIGS. 1A and 1B.
Figure 3:
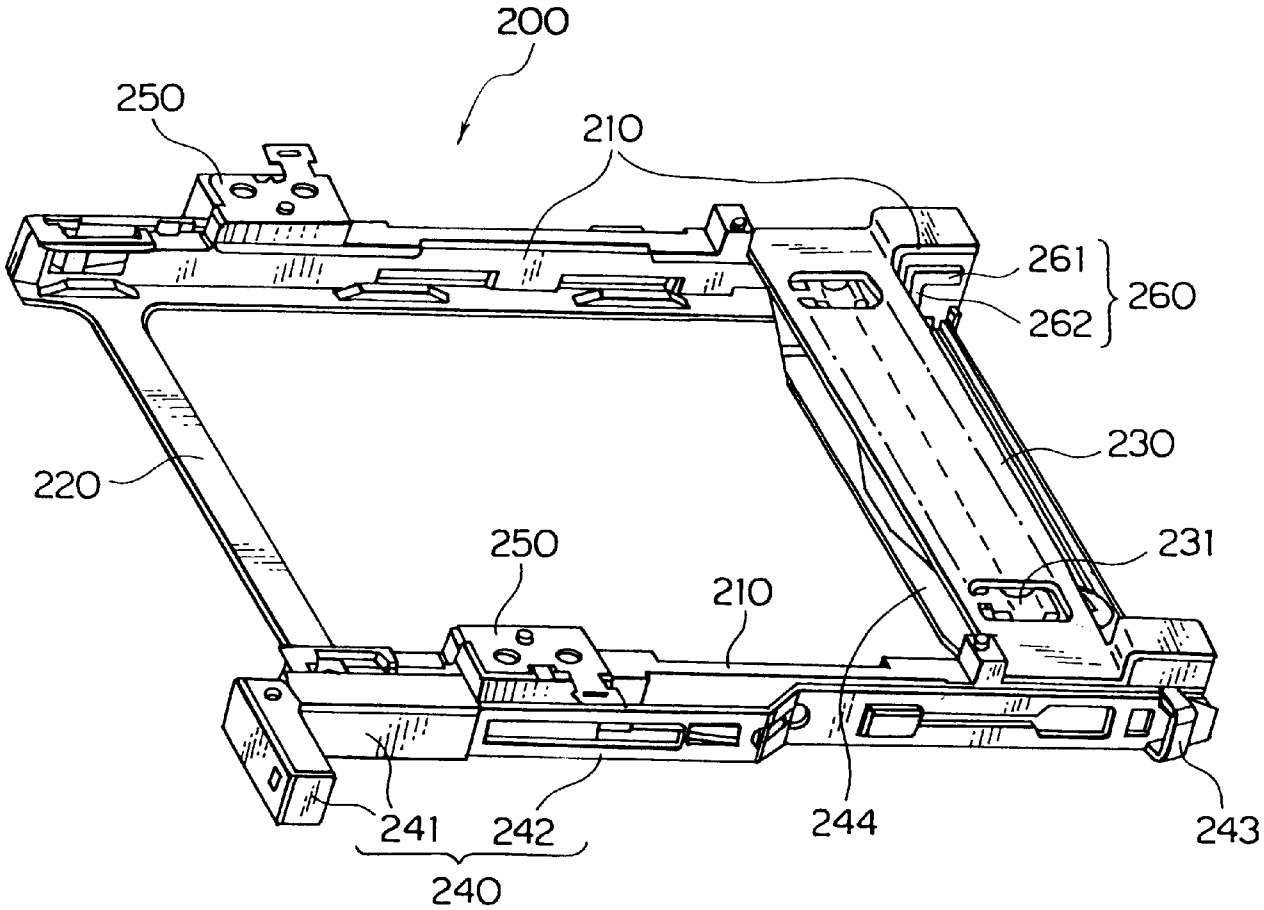
FIG. 3 is a perspective view of a frame element included in the card connector of FIGS. 1A and 1B.

With reference to FIGS. 1 through 5B, description will be made as regards a card connector according to an embodiment of the present invention. The card connector comprises similar parts designated by like reference numerals.

In the card connector, a projection portion 140 has a predetermined size and length in a third direction perpendicular to the first and the second directions. The projection portion 140 is provided on each of opposite side surfaces of an insulator 120 of a connector which is similar with the conventional connector 100*x*, at an outer portion of an array of the pin contacts 110, to provide a connector element 100. A frame element 200 is formed such that a bank-like portion is formed on each of opposite surfaces relative to the opposite end surfaces of the insulator 120 at the connection portion between each card guide portion 210 of the frame element 200*x* and the insulator 120. The bank-like portion comprises a laterally elongated portion 261 which is parallel with the card insertion-withdrawal direction, and a vertically elongated portion 262 connected with the laterally elongated portion 261. A combination of the vertically and the laterally elongated portions 261 and 262 will be called hereinunder a projection guide 260.

When the card guides 210 are coupled with the opposite end portions of the insulator 120 of the connector element 100 fixed to the mounting board 300, a projection portion 140 on each of the opposed end surfaces of the insulator 120 is suitably contacted with, and guided along, the upper side of the laterally elongated portion 261 so that no contact is formed between the pin contacts 110 and the grounding metal plate 230. When a lower portion of the laterally elongated portion 261 is happened to be more or less contacted with the projection portion 140 of the opposed ends of the insulator 120, the projection guide 260 serves to prevent the outer side of the grounding metal plate 230 from contacting the pin contacts 110. Thus, the frame element 200 of the card connector is prepared as described above.

Figure 4A:
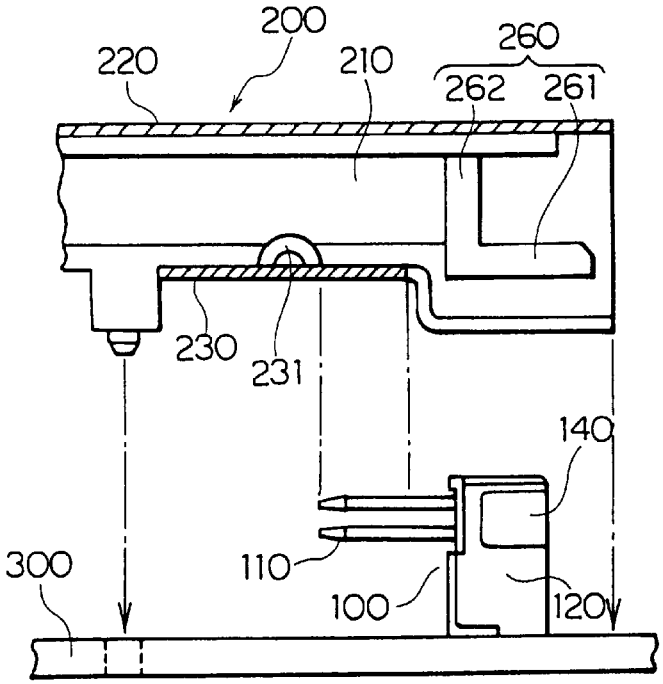
FIGS. 4A and 4B are partly sectioned side views of the card connector of FIGS. 1A and 1B, respectively.
Figure 4B:
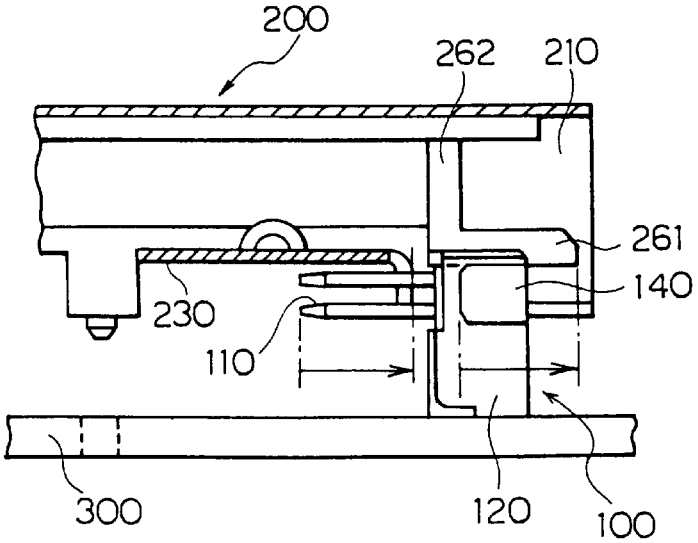

In the card connector described above, when the frame element 200 is tried to be coupled with the connector element 100 fixed to the mounting board 300 by simply putting the frame element 200 from above the connector 100, as shown in FIG. 4A, without taking care that the grounding metal plate 230 is not interfered with the pin contacts 110, these elements 110 and 200 will not be successfully coupled with each other. This is because the projection portion 140 is contacted or collided with or the lower side of the laterally elongated portion 261 to prevent a contact between the grounding metal plate 230 and the pin contacts 110 as shown in FIG. 4B. In FIG. 4B, an arrow represents that, if the projection portion 140 is displaced out of the laterally elongated portion 261, the grounding metal plate 230 is moved beyond the position, where the grounding metal plate 230 is no more overlapped with the pin contacts 110.

Figure 5A:
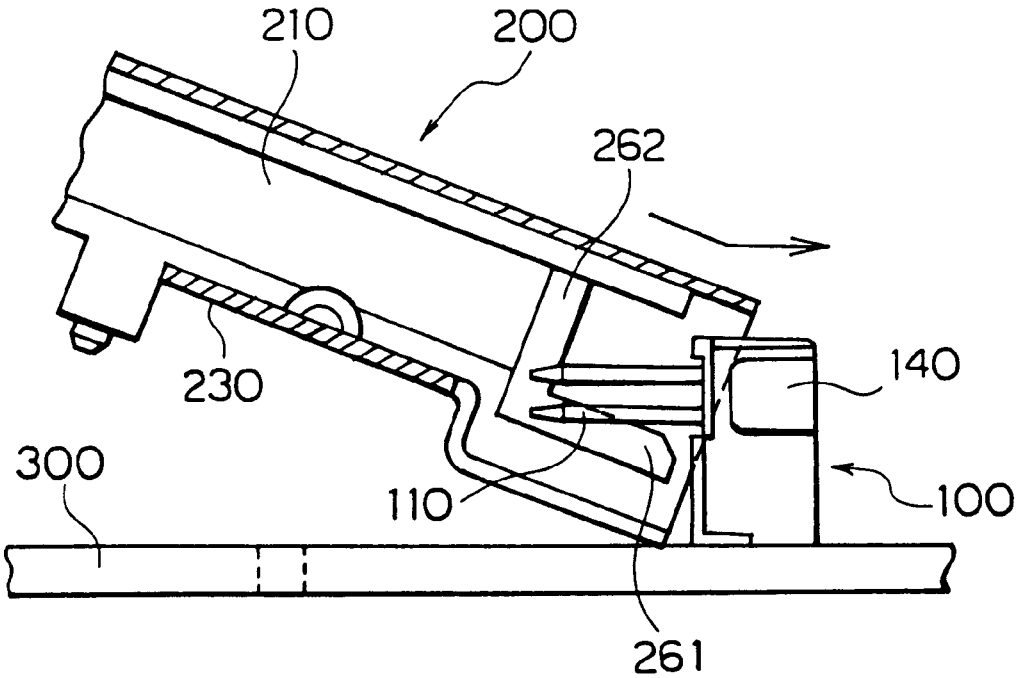
FIGS. 5A and 5B are partly sectioned, explanatory side views, showing process and operation of coupling the frame element with the connector element fixed to the mounting board.

In order to make the frame element 200 be coupled with the connector element 100 fixed to the mounting board 300, the frame element 200 is made inclined at first as shown in FIG. 5A. With this posture, a tip end portion of the frame element 200 is contacted with a surface of the mounting board 300 and then moved toward the connector element 100 as shown by an arrow. After that, the projection portion 140 of the connector element 100 is introduced into an upper side of the laterally elongated portion 261 of the projection guide 260.

Figure 5B:
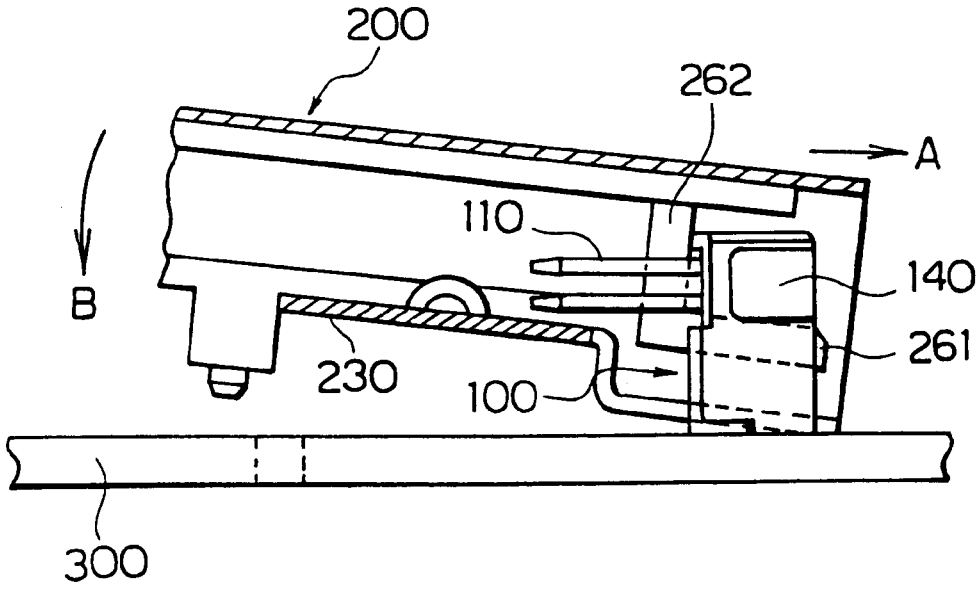
Figure 6A:
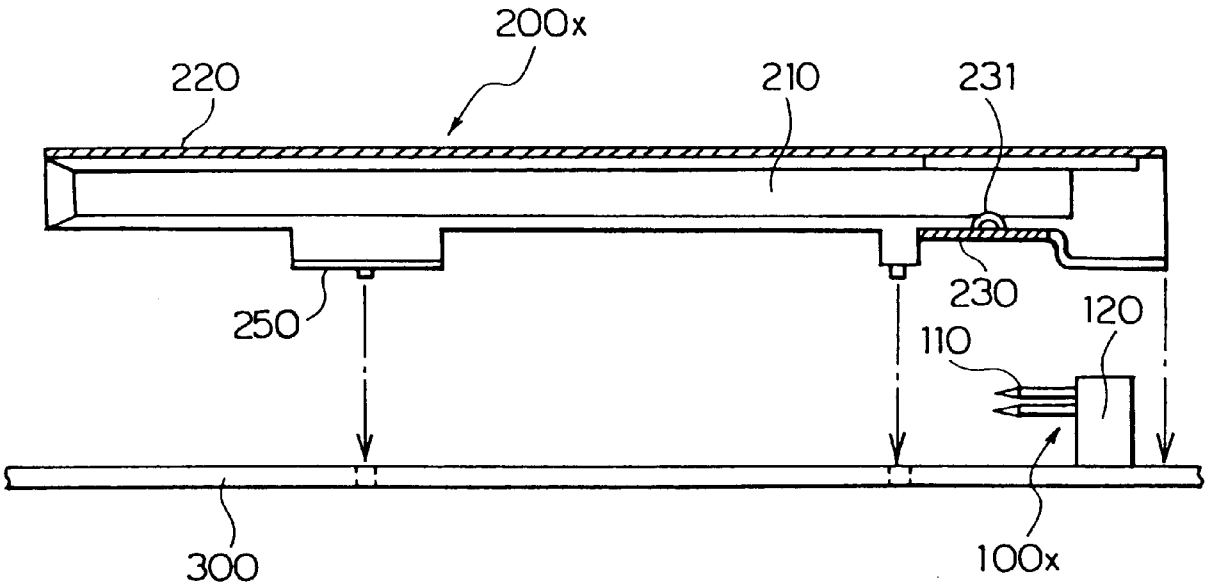
FIG. 6A PRIOR ART
Figure 6B:
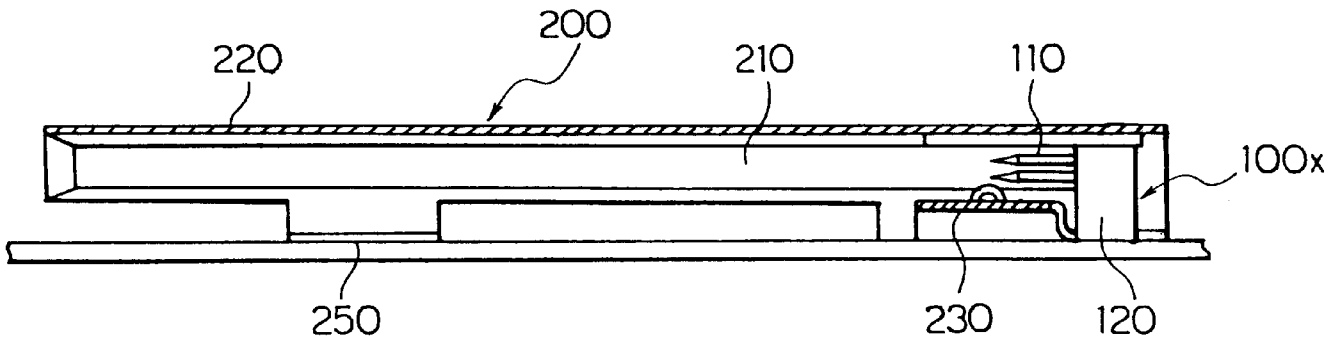
FIG. 6B PRIOR ART
Figure 7:
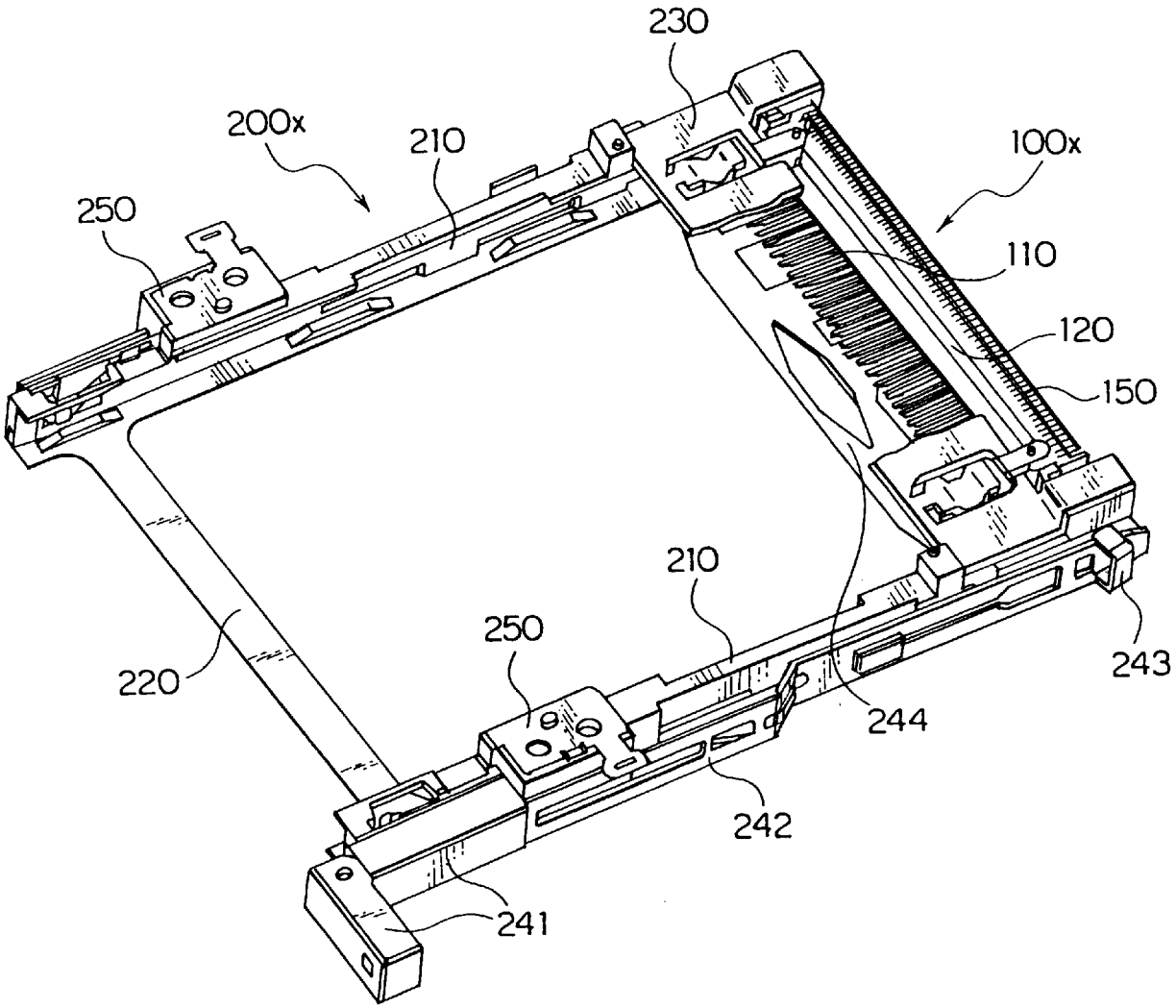
FIG. 7 PRIOR ART
FIG. 7 is a perspective view of the conventional card connector of FIGS. 6A and 6B.
Figure 8:
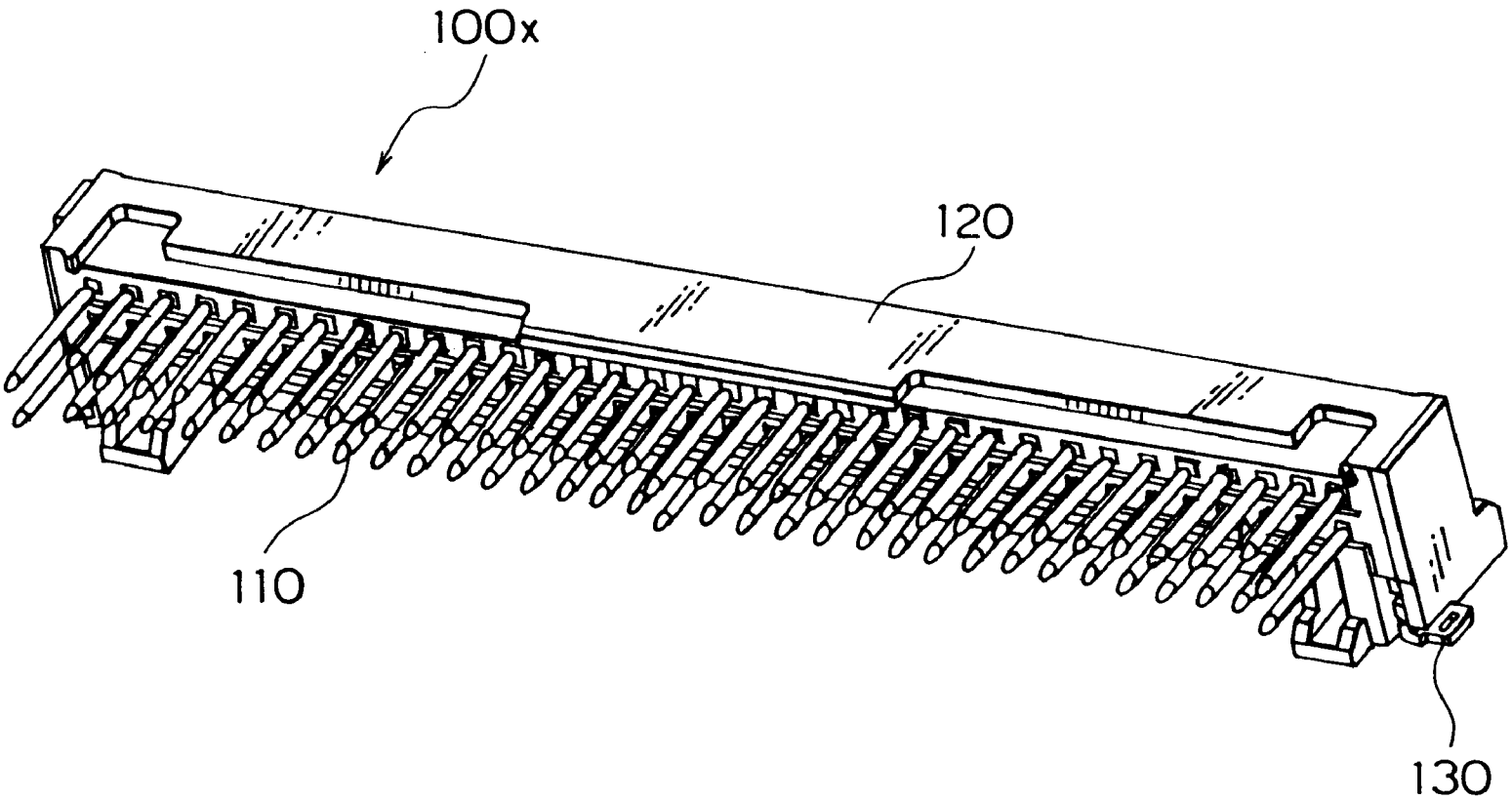
FIG. 8 PRIOR ART
FIG. 8 is a perspective view of a connector element included in the conventional card connector of FIGS. 6A and 6B.
Figure 9:
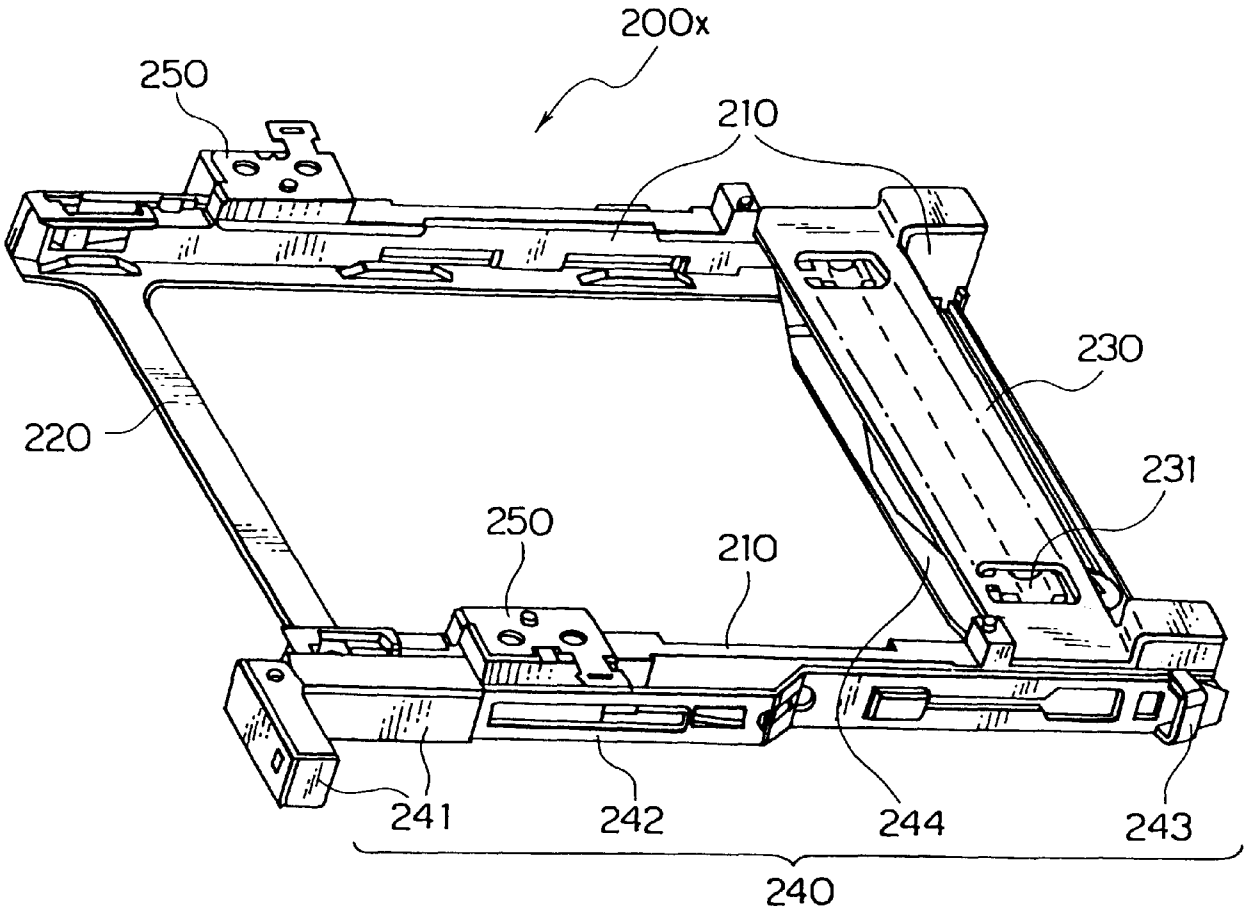
FIG. 9 PRIOR ART
FIG. 9 is a perspective view of a frame element included in the conventional card connector of FIGS. 6A and 6B.
Figure 10:
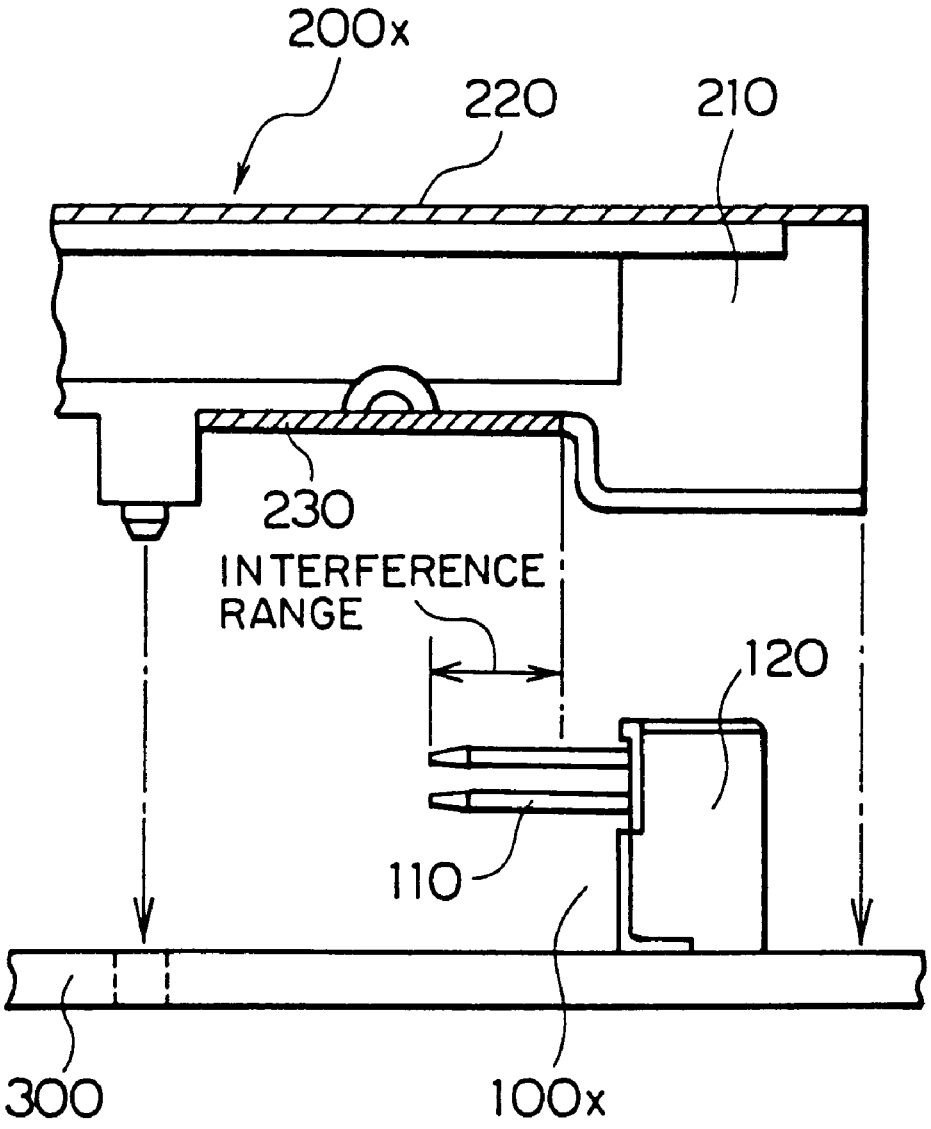
FIG. 10 PRIOR ART
FIG. 10 is a partly sectioned side view of the conventional card connector of FIGS. 6A and 6B for describing the problems to be solved by the invention.

When frame element 200 is continuously moved toward the connector element 100, the projection portion 140 is contacted with the upper side of the laterally elongated portion 261. At this moment, there is a positional relation that tips of the pin contacts 110 are not in contact with the grounding metal plate 230. A further movement of the frame element 200 permits the upper side of the laterally elongated portion 261 to be guided by the projection portion 140 as shown in FIG. 5B. As the movement continues (shown by an arrow A), the frame element 200 is turned or rotated to the direction which is parallel to the mounting board 300 (shown by an arrow B). As a result, the connector element 100 can be coupled with the frame element 200 without a contact between the grounding metal plate 230 and the pin contacts 110.

When the coupling between the connector element 100 and the frame element 200 is established, the projection portion 140 is abutted against the vertically elongated portion 262 to thereby serve as a stopper. In this respect, if a predetermined, positional relation is established satisfactorily without the stopper at the time of coupling, the vertical elongated portion 262 can be omitted. When it is required that the frame element 200 is released from or uncoupled with the connector element 100, it is quite enough to proceed a reversal operation of the above-described coupling operation. In a similar manner as the above, the grounding metal plate 230 is not contacted with the pin contacts 110.

Accordingly, when coupling and releasing is made between the frame element 200 and the connector element 100 fixed to the mounting board 300, it is not required to take care of possible interference between the grounding metal plate 230 and the pin contacts 110. Namely, there is no fear or danger of collision between the grounding metal plate 230 and the pin contacts 110 when the coupling and/or releasing operations are proceeded. Therefore, it is possible to prevent the pin contacts 110 from being bent and/or damaged in any way.

According to the card connector, the connector element 100 is provided, at its opposite ends, with the projection portions 140, the frame element 200 being provided with the projection guide 260 having a laterally elongated portion 261 which is parallel with the card insertion-withdrawal direction at a coupling portion between the frame element 200 and the connector element 100. When the frame element 200 is coupled with or released from the connector element 100 fixed to the mounting board 300, an upper side of the laterally elongated portion of the projection guide 260 is suitably guided by the projection portion 140 so that a contact or abutment is prevented between the grounding metal plate 230 and the pin contacts 110. When it is tried that frame element 200 is to be coupled with the connector element 100 by pushing it from the above toward the connector element 100, a lower side portion of the laterally extended portion 261 of the projection guide 260 is abutted against the projection portion 140. Therefore, the grounding metal plate 230 is prevented from being contacted with the pin contacts 110. In the operation of coupling and uncoupling between the frame element 200 and the connector element 100 fixed to the mounting board 300, no special care or attention is required to take with respect to interference between the grounding metal plate 230 and the pin contacts 110. As a result, desirable coupling and uncoupling operation can be made successfully by successfully preventing the pin contacts 110 from being broken or damaged.

What is claimed is:

1. A card connector for use in connecting a card having a principal surface, an end surface adjacent to said principal surface, a contacting portion at said end surface, and a grounding electrode on said principal surface in the vicinity of said end surface, said card connector comprising:

a connector element fixedly mounted at a first position on a mounting board; and a frame element detachably mounted at a second position on said mounting board, said connector element comprising:

a pin contact for coming into contact with said contracting portion of the card;

an insulator holding said pin contact in a form in which said pin contact extends in a first direction and in which a first space is left between said pin contact and said mounting board in a second direction which is perpendicular to said first direction; and a projection portion projecting from said insulator in a third direction perpendicular to said first and said second directions, a second space being left between said projection portion and said mounting board in said second direction, said frame element comprising:

a card guide extending from said connector element for movably guiding said card in said first direction;

a grounding metal plate connected to said card guide and placed in said first space for coming into contact with said grounding electrode of the card; and a projection guide extending from said card guide in said first direction and inserted in said second space for being engaged with said projection portion to prevent said frame element from being detached in said second direction, said projection portion and said projection guide having relative sizes and positions in said first direction to prevent said grounding metal plate from confronting said pin contact in said second direction when said frame element is displaced from said second position to a position where said projection guide is offset from said projection portion in said first direction and said grounding metal plate confronting said pin contact in said second direction when said frame element is placed at said second position.

2. A card connector for mounting a card on a mounting board, said card having a plurality of contacting portions along one side thereof and a plurality of grounding electrodes arranged adjacent to said contacting portions so that said contacting portions and said grounding portions are connected respectively with electrodes and grounding pads of said mounting board when said card is inserted into said card connector, said card connector comprising a connector element and a frame element which are mounted on said mounting boards, said connector element comprising:

a plurality of pin contacts having one end portion connected with said contacting portions and another end portion connected with said electrodes of the mounting board;

an insulator adaptable to said mounting board for holding said pin contacts with axes of said pin contacts being parallel with an insertion-withdrawal direction of said card; and projection portions projecting outwardly from ends of said insulator, said frame element comprising:

a card guide connected with the opposite end portions of said insulator and extended in said insertion-withdrawal direction for guiding the opposite side surface portions of said card at the time of insertion-withdrawal of said card;

a frame portion for coupling said card guide with each other;

a grounding metal plate for coupling said card guide with each other at the portion adjacent to the connector element at the lower portion and connected with said grounding electrodes of the inserted card to connect said grounding electrodes with said grounding pads; and a projection guide in the form of a bank extending laterally and parallel with said insertion-withdrawal direction and having a predetermined shape and height on a surface of said card guide opposite to the opposed end surfaces of said insulator at the connected portion between said card guide and said connector element;

said projection guide preventing contact between said grounding metal plate and said pin contacts when said card guide is coupled with the opposed end portion of said insulator to prevent the outer portion of said grounding metal plate from contacting said pin contacts when said projection portion of the opposed end surfaces of said insulator happens to contact the longitudinally extending bank.

3. A card connector according to claim 2, wherein said projection guide is formed into a hook shape containing a vertically extending portion serving as a stopper for said projection portion.

* * * * *